US006382687B1

(12) United States Patent
Gruhn

(10) Patent No.: US 6,382,687 B1
(45) Date of Patent: May 7, 2002

(54) POWER-CLOSING MOTOR-VEHICLE DOOR LATCH

(75) Inventor: Klaus Gruhn, Mönchengladbach (DE)

(73) Assignee: Kiekert AG, Heiligenhaus (DE)

( * ) Notice: Subject to any disclaimer, the term of this patent is extended or adjusted under 35 U.S.C. 154(b) by 108 days.

(21) Appl. No.: 09/649,630

(22) Filed: Aug. 28, 2000

(30) Foreign Application Priority Data

Sep. 4, 1999 (DE) ..... 199 42 360

(51) Int. Cl.[7] ..... E05C 3/06

(52) U.S. Cl. ..... 292/201; 292/216; 292/DIG. 43; 292/DIG. 23

(58) Field of Search ..... 292/292, 216, 292/201, DIG. 23, DIG. 43

(56) References Cited

U.S. PATENT DOCUMENTS

| | | | | |
|---|---|---|---|---|
| 5,137,311 A | * | 8/1992 | Brackmann | 292/216 |
| 5,603,537 A | * | 2/1997 | Amano et al. | 292/201 |
| 5,639,130 A | * | 6/1997 | Rogers et al. | 292/199 |
| 5,697,237 A | * | 12/1997 | Dilger et al. | 292/201 |
| 5,802,894 A | | 9/1998 | Jahrsetz | |
| 5,934,717 A | * | 8/1999 | Wirths et al. | 292/201 |
| 5,938,253 A | * | 8/1999 | Szablewski et al. | 292/201 |
| 6,000,257 A | * | 12/1999 | Thomas | 292/201 |
| 6,067,826 A | * | 5/2000 | Holloway et al. | 292/201 |
| 6,076,868 A | * | 6/2000 | Roger et al. | 292/199 |
| 6,148,651 A | * | 11/2000 | Roncin | 292/201 |

FOREIGN PATENT DOCUMENTS

| | | |
|---|---|---|
| DE | 38 36 771 | 1/1990 |

* cited by examiner

*Primary Examiner*—Anthony Knight
*Assistant Examiner*—Matthew E. Rodgers
(74) *Attorney, Agent, or Firm*—Herbert Dubno; Andrew Wilford

(57) ABSTRACT

A power-closing motor-vehicle door latch has a housing and a fork engageable around a bolt, formed with an abutment, and pivotal on the housing from an open position through a partially closed position into a fully closed position. A latch pawl engageable with the fork in the partially and fully closed positions can retain the fork therein. A rocker is pivotal on the housing between inner and outer positions and a closing pawl is pivoted on the rocker between an entrainment position engageable with the fork abutment and a freeing position. A crank drive displaces the rocker outward toward the outer position with the closing pawl in the entrainment position so as to pivot the fork from the partially closed position into the fully closed position. A control member is pivotal on the rocker between a pair of end positions. An actuation formation on the control member and an abutment on the housing displace the control member into one of its end positions on displacement of the rocker into the outer end position and displace the control member into the other of its end positions on displacement of the rocker inward into the inner end position. A spring engaged between the control member and the closing pawl urges the closing pawl into the freeing position when the control member is in the one end position and urges the closing pawl into the engaging position when the control member in the other end position.

11 Claims, 3 Drawing Sheets

POWER-CLOSING MOTOR-VEHICLE DOOR LATCH

FIELD OF THE INVENTION

The present invention relates to a motor-vehicle door latch. More particularly this invention concerns such a latch with a power-closing feature.

BACKGROUND OF THE INVENTION

A standard motor-vehicle door latch has a housing normally mounted on a door edge, a fork engageable around a bolt normally carried on a door post and pivotal on the housing from an open position through a partially closed position into a fully closed position, and a latch pawl engageable with the fork in the partially and fully closed positions to retain the fork therein. In a power-closing latch a rocker is provided with a closing pawl that can engage the fork once a sensor reports that the fork is in the partially latched position to push the fork into the fully closed position. Thus the user pushes the door closed so that the partially closed position is assumed, and thereafter the power-closing system pulls the door fully closed. Such a system ensures that the door is very tightly closed without requiring the user to use an untoward effort or slam the door.

In the system described in German patent document 3,836,771 of Deischl the power-closing mechanism is connected to the linkage between the door handle and the latch pawl. In another system described in commonly owned U.S. Pat. No. 5,802,894 an electric motor is used for the power closing and in case of a power failure the latch cannot be operated, in general the systems interfere with standard manual actuation of the latch and often are inordinately complex.

OBJECTS OF THE INVENTION

It is therefore an object of the present invention to provide an improved power-closing motor-vehicle door latch.

Another object is the provision of such an improved power-closing motor-vehicle door latch which overcomes the above-given disadvantages, that is which is relatively simple and which allows the door to be opened manually even in the event of a total power failure of the vehicle.

SUMMARY OF THE INVENTION

A power-closing motor-vehicle door latch has according to the invention a housing and a fork engageable around a bolt, formed with an abutment, and pivotal on the housing from an open position through a partially closed position into a fully closed position. A latch pawl engageable with the fork in the partially and fully closed positions can retain the fork therein. A rocker is pivotal on the housing between inner and outer positions and a closing pawl is pivoted on the rocker between an entrainment position engageable with the fork abutment and a freeing position unengageable with the fork abutment. A crank drive displaces the rocker outward toward the outer position with the closing pawl in the entrainment position so as to pivot the fork from the partially closed position into the fully closed position and displaces the rocker oppositely inward toward the inner position. A control member is pivotal on the rocker between a pair of end positions. An actuation formation on the control member and an abutment on the housing displace the control member into one of its end positions on displacement of the rocker into the outer end position and displace the control member into the other of its end positions on displacement of the rocker inward into the inner end position. A spring engaged between the control member and the closing pawl urges the closing pawl into the freeing position when the control member is in the one end position and urges the closing pawl into the engaging position when the control member in the other end position.

Thus with this system the power-closing system is only engaged with the lock form when it is moving it from the partially closed to the fully closed position. Otherwise it is disengaged from the fork so that the latch can be operated normally, even if all on-board power has failed.

According to the invention the control member is formed with an arcuate slot and the rocker is provided with a pin engageable with respective ends of the slot in the end positions of the control member. Alternately the rocker could be formed with slot and the pin could be provided on the control member. Either way the slot is made narrow in the center so that the system is metastable, with the pin only resting stably in one end or the other of the slot. The slot and control-member actuation formation are on opposite sides of the control member.

In accordance with the invention the rocker and fork are coaxially pivoted and similarly the control member and closing pawl are coaxially pivoted. Thus the closing pawl will bear angularly on the fork for excellent force transmission.

According to another feature of the invention an actuation formation on the closing pawl and an abutment on the housing retain the closing pawl in the freezing position in the inner position of the rocker. Thus only when the rocker is raised by the drive from its outer position is the spring force able to move the closing pawl into the entrainment position.

The control member and the closing pawl according to the invention are pivoted on a common pivot and are each provided offset therefrom with a respective axially extending pin. The spring can be a torque spring engaged around the pivot and having a pair of arms engageable with the pins. Of course another type of spring, for instance a tension spring hooked on radially offset points on the control member and closing pawl.

The power-closing motor-vehicle door latch wherein the actuator includes two abutments on the housing engageable with the control-member actuation formation in the inner and outer positions of the rocker. Thus when the rocker is retracted to its starting position the control member is flipped to reverse the spring bias so that, when the rocker is pushed forward again to power-close the door, the closing pawl will engage the fork. The housing includes a bearing plate forming one of the housing abutments.

The fork according to the invention is formed with a pair of offset abutments engageable with the latch pawl in the partially and fully closed positions of the fork. It is possible for the same abutment of the fork to be engageable with the latch pawl and with the closing pawl.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
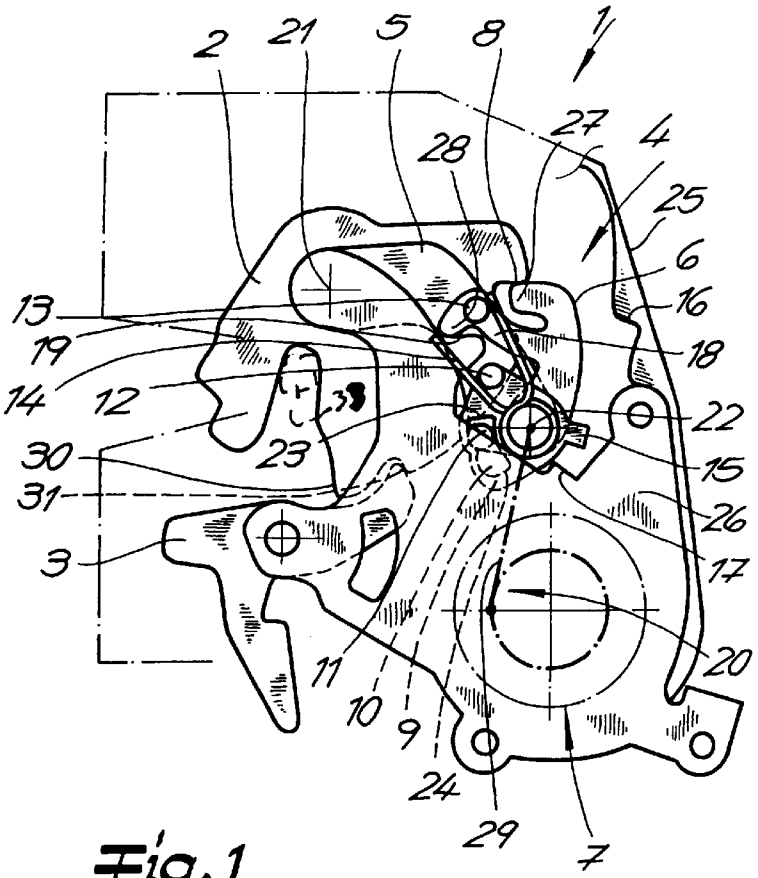
Figure 3:
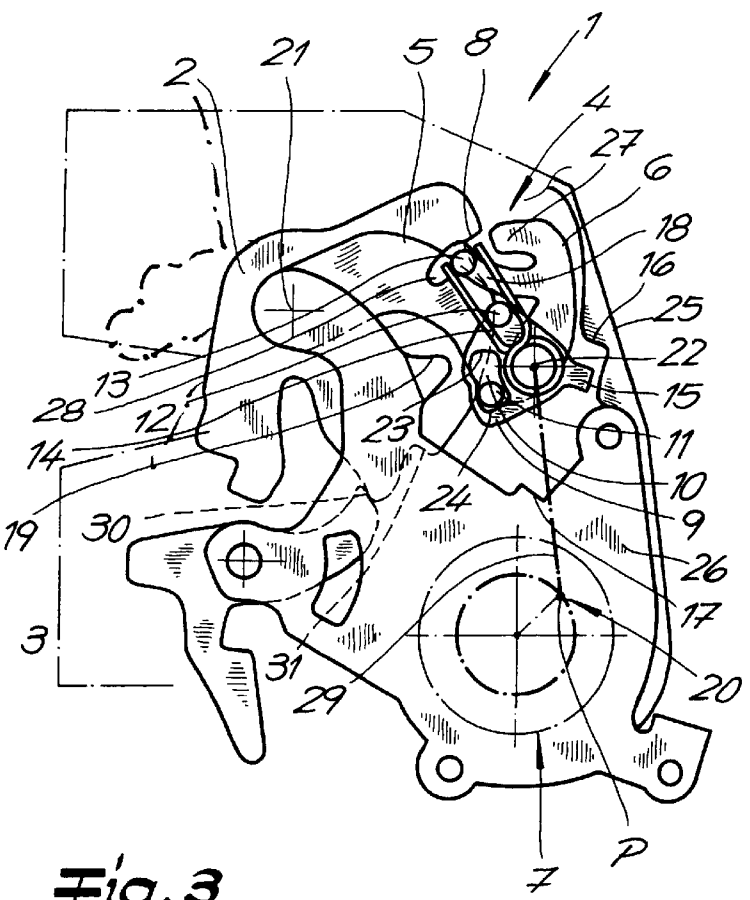

As seen in FIG. 1 a latch 1 according to the invention has a housing 25 normally mounted on a door edge and to which is fixed a bearing plate 26 defining a pivot 21 on which is mounted a standard lock fork 2 engageable around a bolt 33 carried on an unillustrated door post. A standard latch pawl 3 can engage an inner abutment 31 on the fork 2 in a partially locked position (FIG. 1) or an outer abutment 30 in a fully locked position (FIG. 3). This pawl 3 is controlled by unillustrated inside and outside door handles. When pivoted clockwise, normally against the force of a spring, it releases the fork 2 so that bolt 33 can pull out of the latch 1.

A power-closing system 4 comprises a rocker 5 also pivoted at 21 on the housing 25 and having a pivot 22 on which is mounted a closing pawl 6 and a control member 9. An electric-motor drive 7 of the system 4 has a rotary output member 20 to whose periphery is connected a crank 29 also fixed to the rocker 5 at the pivot 22 to pivot it through the various positions shown in FIGS. 1 through 4.

The closing pawl 6 has an actuating nose or formation 27 engageable with an abutment surface 8 of the fork 2 to pivot it counterclockwise about its axis 21. In addition it has an arm 18 carrying a pin 13 engaging one arm of a torque spring 14 looped around the pivot 21 and having another arm bearing on a pin 12 carried on the control member 9 so that the spring 14 effectively links the pawl 6 and member 9 together by urging the two pins 12 and 13 toward each other. An actuation formation 15 formed on the closing pawl 6 is engageable with abutments 16 and 17 formed on the plate 26 of the housing 25. Another actuation formation 28 formed at the end of the arm 18 is engageable with a surface 19 of the plate 26.

The control member 9 is formed centered on the pivot 22 with an arcuate slot 10 having a pair of abutment ends 23 and 24. A pin 11 carried on the rocker 5 is movable along this slot 10. Thus this control member 9 can pivot between a pair of end positions relative to the rocker 5 and in fact the slot 10 is shaped (narrowed in the center) such that the movement is metastable, that is the pin 11 will not rest in the center of the slot 10, but will move to the closer of the two abutment ends 23 and 24. When the member 9 is in the end position of FIGS. 1 and 3 it engages the left-hand arm of the spring 14 and therefore forces the right-hand arm of the spring 14 to press the pin 13 toward the left, urging the closing pawl 6 counterclockwise. When the member 9 is in the end position of FIGS. 2 and 4 it engages the right-hand arm of the spring 14 to press the pin 13 toward the right, urging the closing pawl 6 clockwise. Thus the setting of the control member 9 determines whether the pawl 6 is urged into engagement with or away from the fork 2.

The latch functions as follows:

To start with as shown in FIG .1 the control member 9 is in its position urging the closing pawl 6 clockwise so that it bears on the abutment surface 8 of the fork 2. In this position the latch pawl 3 is engaged with the back abutment 31 of the fork 2 and the bolt 33 is therefore in the partially closed position. Operation of the drive 7 with clockwise rotation of the output member 20 will therefore pivot the rocker 5, and with it the control member 9 and pawl 6, clockwise to pivot the fork 2 clockwise also, thereby pulling the bolt 33 into the fully closed position.

Figure 2:
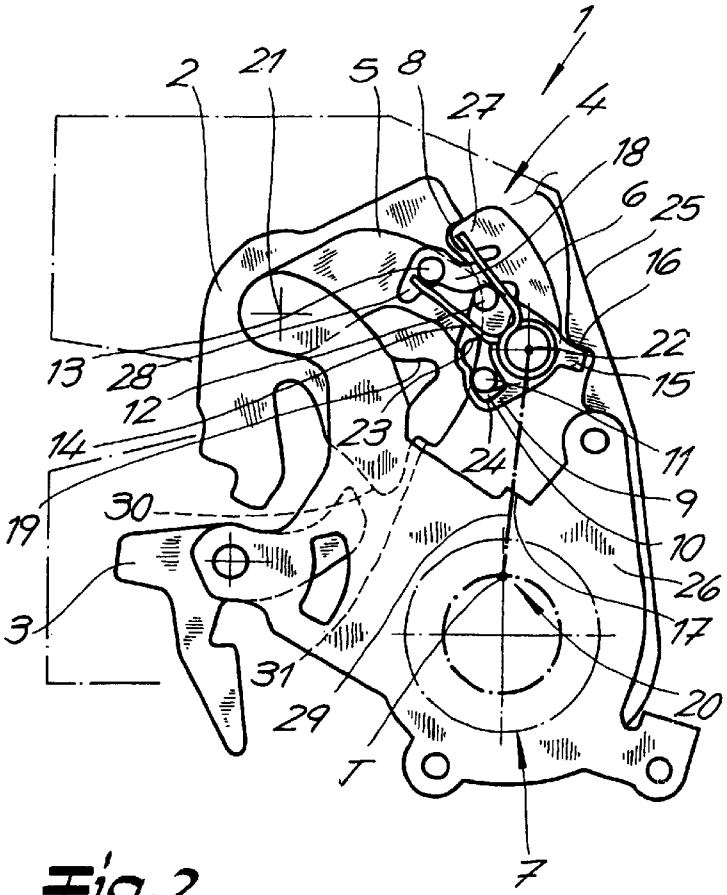
FIGS. 1, 2, 3, and 4 are partly diagrammatic side views illustrating the latch according to the invention in four successive operative positions.

As the parts move from the FIG. 1 position to the FIG. 2 outer position the actuation formation 15 of the control member engages the abutment 16 and is switched to its other position, pressing the right-hand arm of the spring 14 and, therefore, urging the pin 13 to the right. Since, however, the pawl 6 is still in solid engagement with the fork surface 8, so long as the pawl 6 is pushing on the fork 2 the spring force is not sufficient to overcome the friction between the parts and they will remain in contact.

Once the drive 7 passes its top position shown at T, however, and starts to descend, the outer abutment 30 on the fork 2 will catch on the pawl 3 and the pawl 6 will pull away form the surface B, whereupon the force of the spring 14 will pull the closing pawl 6 back into the park position P shown in FIG. 3 and normally will stop there. In this position the unillustrated motor-vehicle door is fully closed and the pawl 6 is pulled back completely out of the path of the abutment 8.

Figure 4:
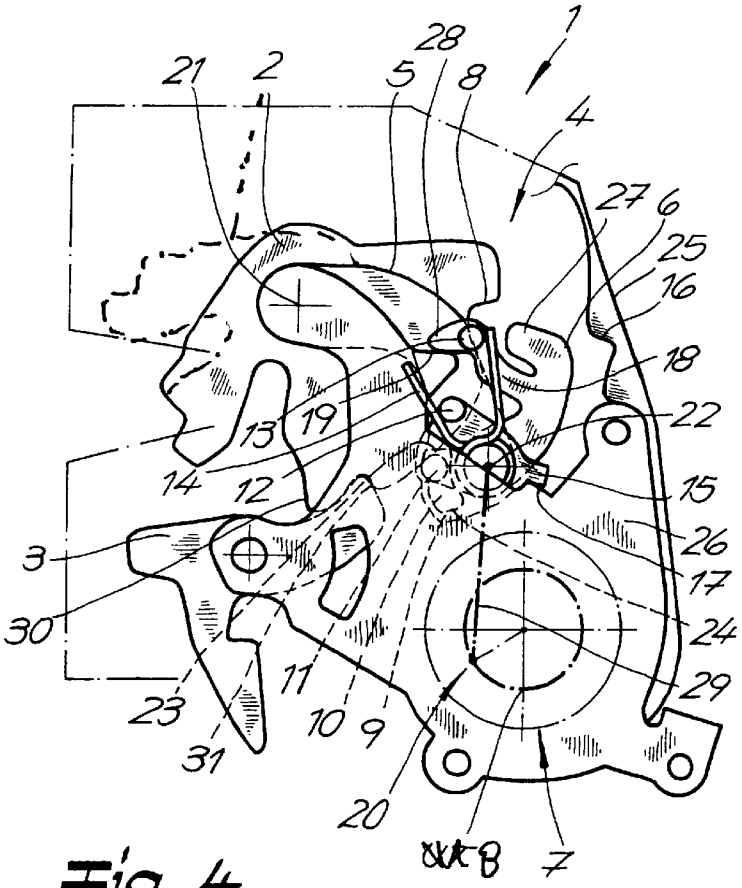

The next time the door is opened, as determined by an unillustrated sensor, the drive 7 moves to the position of FIG. 4, passing through a bottom position B and rising again, so as to bring the formation 15 into engagement with the abutment 17 and pivot the control member 9 back into its starting position bearing on the pin 12 so as to urge the pin 13 and the pawl 6 to the right. In this position, however, the formation 28 of the pawl 6 engages the abutment 19 of the housing 25 so that the pawl 6 cannot pivot clockwise and stays in its retracted position, out of the path of the abutment surface 8. Here, or in fact in any position between that of FIG. 3 and that of FIG. 4, the fork 2 can be released by the latch pawl 3 to pivot out into the position shown in dot-dash lines in FIGS. 2 and 4, opening the vehicle door. Another unillustrated sensor detects when the fork 2 is in the partially closed position of FIG. 1 to start the drive 7 moving back through the above-detailed cycle. Once the formation 29 is lifted off the abutment 19, the pawl 6 will pivot back counterclockwise so its end 27 can engage the abutment 8 of the fork 2.

Figure 6:
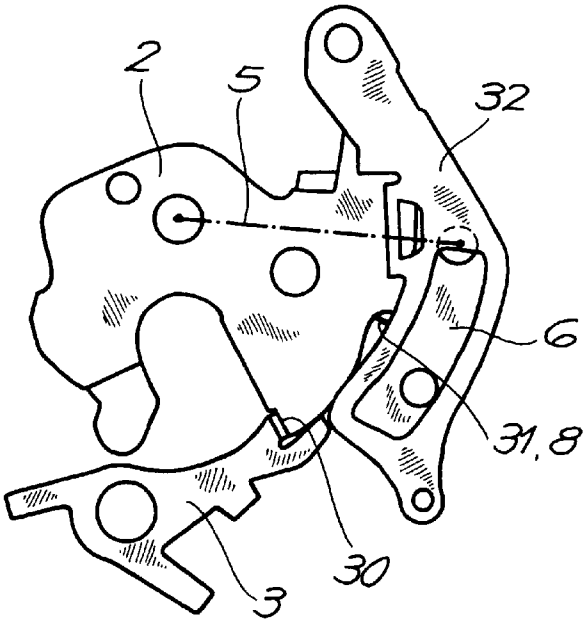
FIG. 6 is a rear view of the alternative mechanism.
Figure 5:
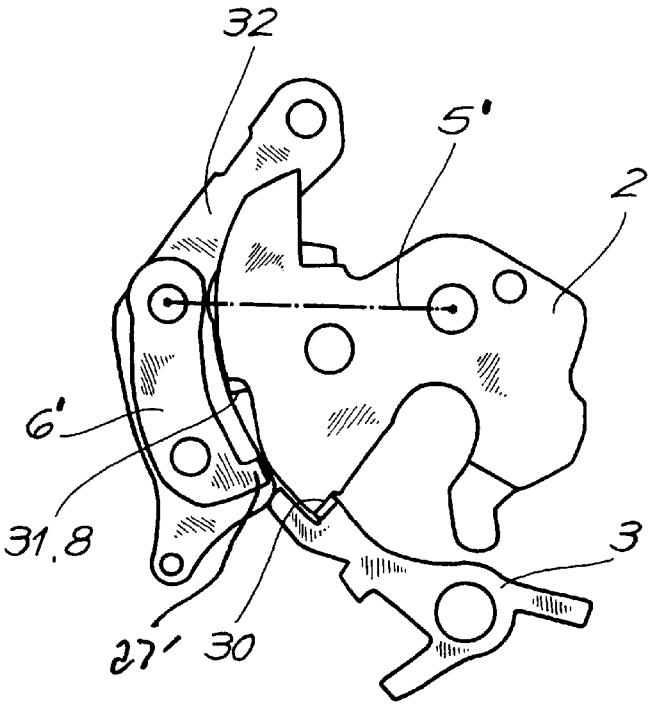
FIG. 5 is a front view of an alternative mechanism for the latch.

FIGS. 5 and 6 show an alternative arrangement where a rocker 5' is shown schematically as a dot-dash line and the pawl 6' is constantly spring biased inward toward the fork 2 and has an end 27' engageable with the abutment formation 31 of the fork 2 which also functions as the abutment 8. Thus once the fork 2 is pivoted sufficiently that the pawl 6' can pivot inward to engage the abutment 8', 31', an unillustrated sensor starts the drive 7 (not shown here) to pivot the rocker 5 and pull the fork 2 back so that the closing pawl 6' can engage the outer abutment 30.

I claim:

1. A power-closing motor-vehicle door latch comprising:

a housing;

a fork engageable around a bolt, formed with an abutment, and pivotal on the housing from an open position through a partially closed position into a fully closed position;

a latch pawl engageable with the fork in the partially and fully closed positions to retain the fork therein;

a rocker pivotal on the housing between inner and outer positions;

a closing pawl pivoted on the rocker between an entrainment position engageable with the fork abutment and a freeing position unengageable with the fork abutment;

a crank drive for displacing the rocker outward toward the outer position with the closing pawl in the entrainment position so as to pivot the fork from the partially closed position into the fully closed position and for displacing the rocker oppositely inward toward the inner position;

a control member pivotal on the rocker between a pair of end positions;

actuating means including an actuation formation on the control member and an abutment on the housing for displacing the control member into one of its end positions on displacement of the rocker into the outer end position and for displacing the control member into the other of its end positions on displacement of the rocker inward into the inner and position; and spring means engaged between the control member and the closing pawl for urging the closing pawl into the freeing position when the control member is in the one end position and for during the closing pawl into the engaging position when the control member in the other end position.

2. The power-closing motor-vehicle door latch defined in claim 1 wherein the control member is formed with an arcuate slot and the rocker is provided with a pin engageable with respective ends of the slot in the end positions of the control member.

3. The power-closing motor-vehicle door latch defined in claim 2 wherein the slot and control-member actuation formation are on opposite sides of the control member.

4. The power-closing motor-vehicle door latch defined in claim 1 wherein the rocker and fork are coaxially pivoted.

5. The power-closing motor-vehicle door latch defined in claim 1 wherein the control member and closing pawl are coaxially pivoted.

6. The power-closing motor-vehicle door latch defined in claim 1, further comprising means including an actuation formation on the closing pawl and an abutment on the housing for retaining the closing pawl in the freeing position in the inner position of the rocker.

7. The power-closing motor-vehicle door latch defined in claim 1 wherein the control member and the closing pawl are pivoted on a common pivot and are each provided offset therefrom with a respective axially extending pin, the spring means including a spring engaged around the pivot and having a pair of arms engageable with the pins.

8. The power-closing motor-vehicle door latch defined in claim 1 wherein the actuating means includes two abutments on the housing engageable with the control-member actuation formation in the inner and outer positions of the rocker.

9. The power-closing motor-vehicle door latch defined in claim 8 wherein the housing includes a bearing plate forming one of the housing abutments.

10. The power-closing motor-vehicle door latch defined in claim 1 wherein the fork is formed with a pair of offset abutments engageable with the latch pawl in the partially and fully closed positions of the fork.

11. The power-closing motor-vehicle door latch defined in claim 10 wherein the same abutment of the fork is engageable with the latch pawl and with the closing pawl.

* * * * *